United States Patent [19]

Gunn et al.

[11] Patent Number: 4,643,107

[45] Date of Patent: Feb. 17, 1987

[54] SECURITY VAULT

[75] Inventors: William L. Gunn; Gerry G. Hull, both of Atlanta, Ga.

[73] Assignee: Bellsouth Corporation, Atlanta, Ga.

[21] Appl. No.: 700,117

[22] Filed: Feb. 11, 1985

[51] Int. Cl.[4] ..... E05G 1/00

[52] U.S. Cl. ..... 109/48; 109/56; 109/73; 312/305

[58] Field of Search ..... 109/48, 53, 56, 73; 312/125, 305

[56] References Cited

U.S. PATENT DOCUMENTS

| | | | |
|---|---|---|---|
| 1,570,882 | 1/1926 | Ellison | 109/48 |
| 2,484,894 | 10/1949 | Lindsay | 312/305 |
| 2,736,628 | 2/1956 | Fadden, Jr. | 312/305 |
| 3,587,485 | 6/1971 | Shea | 109/48 |
| 4,317,604 | 3/1982 | Krakauer | 312/305 |

*Primary Examiner*—Thomas J. Holko
*Assistant Examiner*—Neill Wilson
*Attorney, Agent, or Firm*—Jones & Askew

[57] ABSTRACT

A security vault for receiving and permitting seriatim access to a number of receptacles, which may receive coin boxes used in pay telephones or the like. The receptacles are on multiple tiers of a carousel assembly rotatably mounted within a security barrier. A doorway in the security barrier permits access only to a single receptacle on each tier, as the carousel assembly is indexed in rotation, and a door selects only one tier at a time for access. An indexing and locking mechanism selectively couples the door to the carousel assembly, displacing the door to the next available tier and then locking the door to prevent unauthorized access to any receptacle on a previous tier.

14 Claims, 23 Drawing Figures

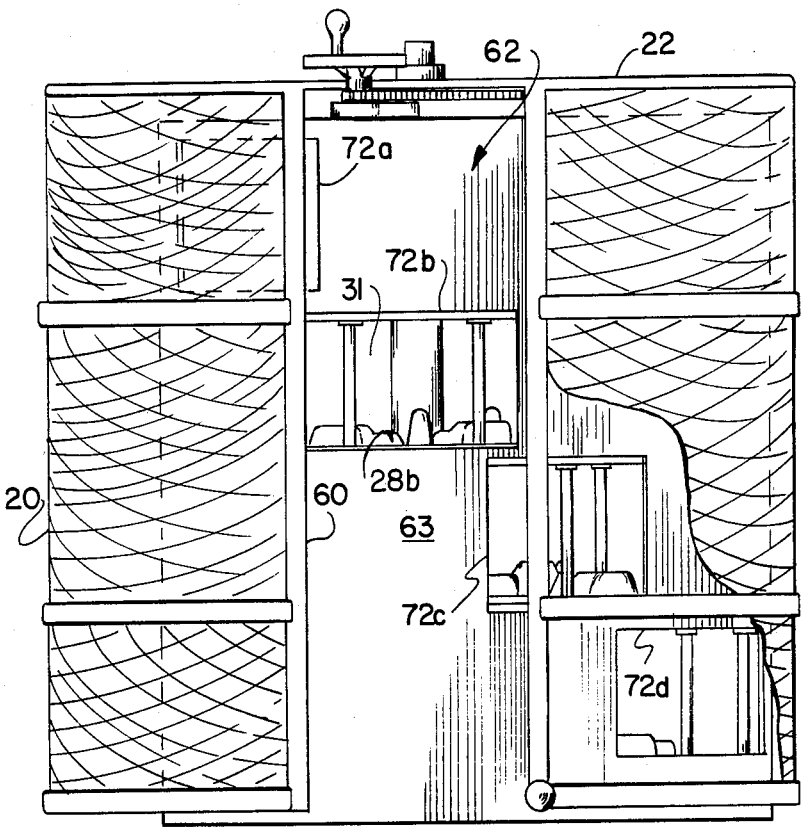
Fig. 5
Fig. 10
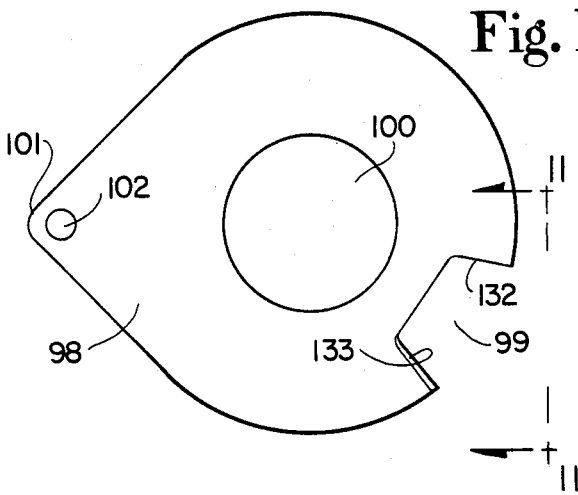
Fig. 11
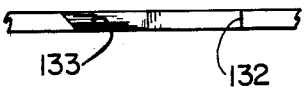

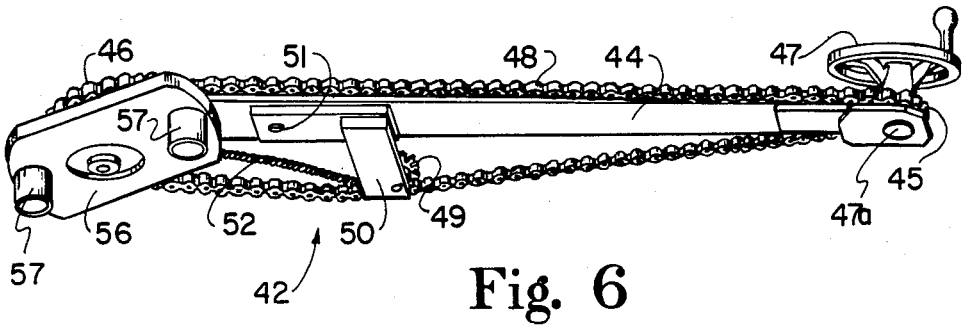
Fig. 6
Fig. 7
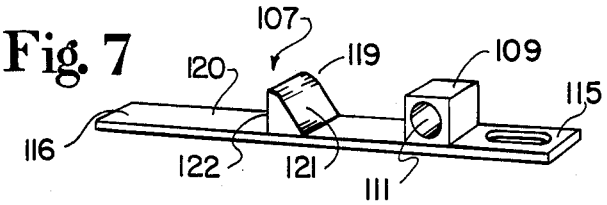
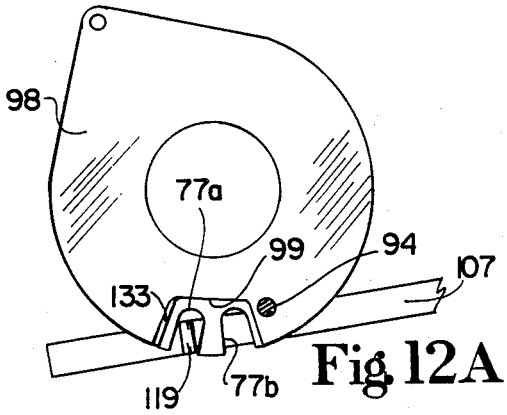
Fig. 12A
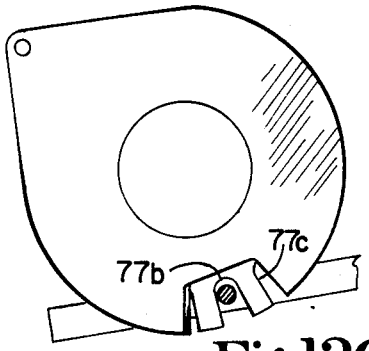
Fig. 12C
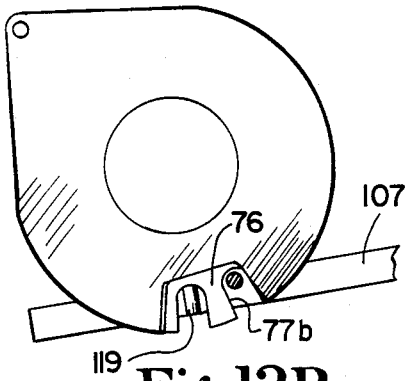
Fig. 12B
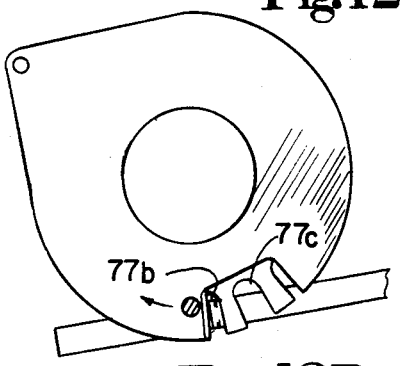
Fig. 12D

SECURITY VAULT

FIELD OF THE INVENTION

This invention relates in general to security vaults, and in particular relates to security vaults for receiving and temporarily storing a number of individual articles such as coin boxes from pay telephones or the like.

BACKGROUND OF THE INVENTION

Cash-receiving devices such as pay telephones and vending machines must be periodically attended to collect and remove the accumulated money. This money typically is transferred to a central location which contains equipment for mechanized sorting and counting of the money.

Although some coin-operated vending machines simply collect the received coins or bills in a container from which an attendant can empty the money on the spot, transferring the accumulated money to a portable vault or other collection device carried in a service vehicle, the accessibility of uncounted coins or other money at each machine presents the temptation of pilferage and the possibility of theft each time money is removed from the machine. One solution to this problem is to equip each cash-operated device with a removable coin box which cannot be opened by the collecting attendant or by a thief, without forcing open the coin box. Conventional pay telephones are one example of coin-operated devices which utilize such removable secure coin boxes. The collecting attendant for the telephone company carries a key which only unlocks a door allowing access to the coin box within the pay telephone. The attendant then removes this coin box, replacing it with an empty coin box carried for the purpose. The individual coin boxes removed from a number of pay telephones are collected and returned to a secure central location, where the coin boxes can be opened to remove and count the money.

Each such individual pay-telephone coin box, while not designed to withstand a prolonged physical assault by a determined thief equipped with suitable cutting tools, is relatively sturdy and thus presents an unattractive target of casual theft. Nonetheless, in an effort to prevent theft of the coin boxes from the collection vehicle, security vaults have been proposed for temporarily storing the coin vaults. Such security vaults typically have separate receptacles for receiving the individual coin boxes as each is removed from a pay telephone; one such apparatus is disclosed in U.S. Pat. No. 3,587,485. The security vault is removably carried in the collection vehicle, and the entire vault is removed from the vehicle at a central location where the vault is opened and all receptacles are removed to empty and count the money.

These security vaults typically allow access to only one coin box at a time by the collecting attendant, who must manipulate some mechanism of the security vault after inserting a coin box therein. This manipulating step typically secures the just-inserted coin box in the security vault, and presents an empty coin box for removal by the attendant. This empty coin box then is swapped with the coin box removed from the next pay telephone being serviced, after which the security vault again is manipulated to secure that coin box and to present another empty coin box. This procedure is repeated on the collecting attendant's rounds until all the empty coin boxes previously loaded into the security vault have been replaced with money-containing coin boxes removed from pay telephones. The attendant then returns to the central location, where the coin boxes are removed from the vehicle security vault under secure conditions.

Such security vaults of the prior art generally prevent more than one coin box at a time from being accessible for possible theft or pilferage. However, such security vaults are characterized by relatively complicated mechanical design, typically using springs, sliding doors, or other components relatively susceptible to jamming or other operational failure. These mechanical problems are compounded by the usual working environment of the security vaults, which are frequently transferred to and from the collection vehicles and subjected to vibration and shaking while carried in the vehicles. Consequently, the operation of the security vaults frequently leaves much to be desired.

SUMMARY OF THE INVENTION

Stated in general terms, the security vault of the present invention defines plural sets of receptables for receiving items such as coin boxes or the like. Each of these receptable sets, in turn, has a plurality of individual article-receiving receptacles. The receptacle support structure, including the plural sets of receptables and the coin boxes or other articles contained in those receptacles, is contained within a security barrier which blocks access to more than one set of receptacles at a time. The receptacle support structure is mounted for indexing movement relative to the security barrier, allowing each receptacle of a particular set to move seriatim past an access opening formed in the barrier. After the last receptacle of a set has been accessed in this manner, the security barrier is automatically repositioned to secure that set and to expose another set of receptacles to seriatim access in response to continued indexing movement of the support apparatus relative to the barrier.

Stated somewhat more particularly, the article-receiving receptacles are formed on a carousel arrangement rotatably mounted within the security barrier. The carousel includes several separate tiers coaxially spaced apart from each other, and defining the separate sets of receptacles. Each tier, in turn, is divided into a number of sectors, thereby defining the individual receptacles for that tier. An indexing mechanism allows the operator to rotate the carousel from outside the security barrier, moving the sectors seriatim past a doorway in the security barrier. However, a door located at this doorway permits access only to one selected tier as the carousel rotates, so that only the sectors of that tier (and the coin boxes or other articles previously loaded into those sectors) are accessible seriatim as an operator indexes the carousel. When the last sector of a particular tier has moved past the doorway, the door automatically shifts to permit seriatim access to a next tier of the carousel and to block further access to the previous tier.

Stated even more particularly, the door of the present security vault defines individual openings corresponding to the separate tiers of the carousel. This door is movably positionable with respect to the doorway in the security barrier, and the selected position of the door thus determines which tier becomes accessible as the carousel is indexed. As the carousel is indexed to move the sectors of a tier past the doorway, the door remains locked in one position holding a door opening in a particular alignment with the doorway. When the carousel completes one revolution or otherwise moves the last sector of a tier past the doorway and the aligned opening in the door, a mechanism automatically unlocks the door and interconnects the door with the rotatable carousel. As the operator further indexes the carousel, the door is repositioned by moving with the carousel, closing the door opening associated with the previous sector and opening the door opening for the next sector. After this realignment of the door takes place, the door is automatically disengaged from the carousel and locked in its new position, so that further indexing of the carousel moves the sectors of the next tier seriatim past the doorway and the newly-aligned opening in the door.

Accordingly, it is an object of the present invention to provide an improved security vault.

It is another object of the present invention to provide an improved security vault for seriatim dispensing and receiving individual articles such as coin boxes or the like.

It is still another object of the present invention to provide an improved coin box security vault permitting access only to one individual coin box receptacle at a time.

It is a further object of the present invention to provide a coin box security vault of the kind having plural tiers of receptacles, and permitting indexing access to the receptacles of each tier one at a time, and automatically shifting to the receptacles of the next available tier, all by operating a single indexing means.

Other objects and advantages of the present invention will become more readily apparent from the following description of a preferred embodiment, as shown and described with respect to the drawings.

BRIEF DESCRIPTION OF DRAWINGS

FIG. 5 is an elevation view of the doorway in the disclosed embodiment, showing the closure aligned with one tier of the carousel.

FIG. 6 is a pictorial view of the indexing drive assembly for the carousel in the disclosed embodiment.

FIG. 7 is a pictorial view showing the detent lever of the disclosed embodiment.

FIG. 10 is a plan view of the cover plate in the door drive assembly.

FIG. 11 is an elevation view taken on line 11—11 of FIG. 10.

FIGS. 12A–12D are fragmentary top plan views partially sectioned and showing the door drive assembly in sequential stages of an operating cycle.

DESCRIPTION OF PREFERRED EMBODIMENT

Figure 1:
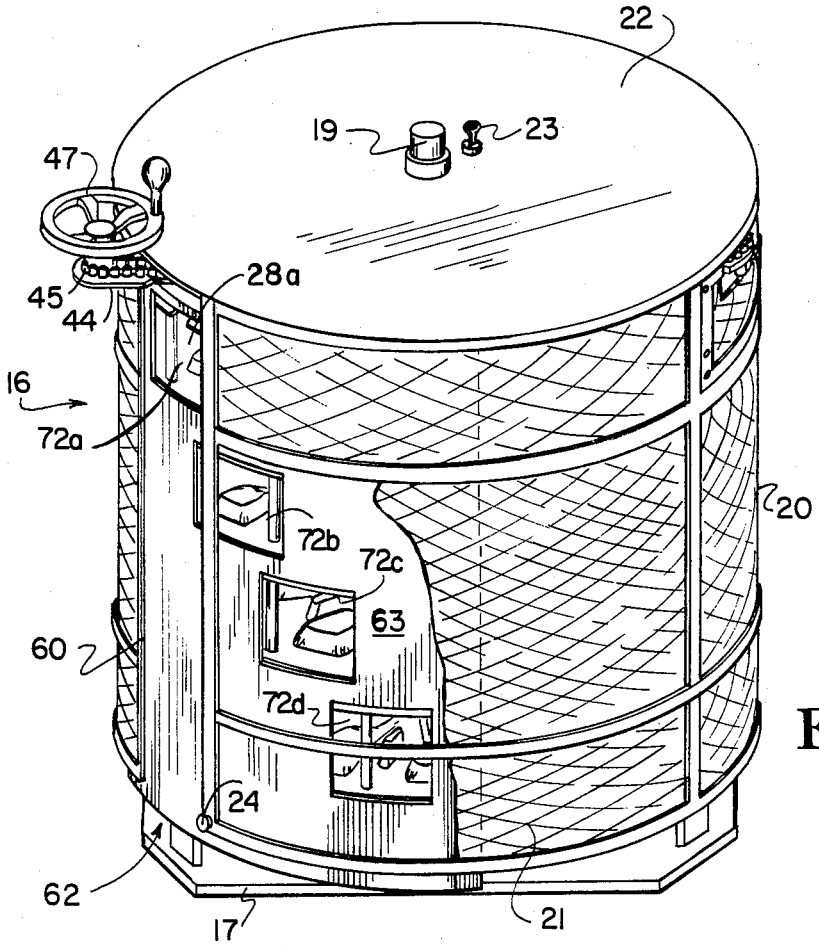
FIG. 1 is a pictorial view of a security vault according to a preferred embodiment of the present invention.
Figure 2:
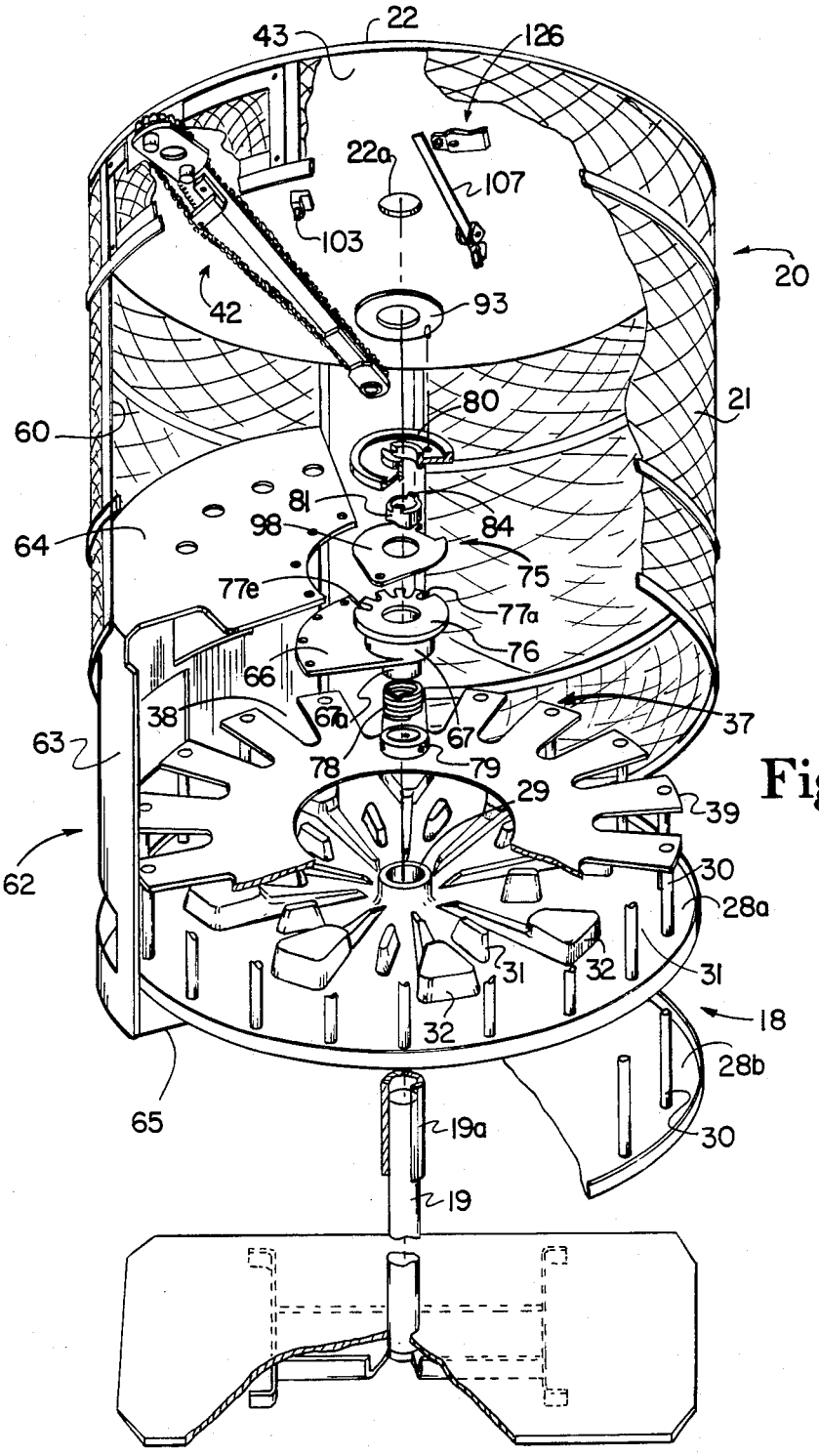
FIG. 2 is an exploded view of the security vault shown in FIG. 1.

Turning first to FIGS. 1 and 2, there is shown generally at 16 a security vault according to a preferred embodiment of the present invention. This embodiment is designed specifically for holding pay telephone coin boxes, and those skilled in the art will understand that such security vaults are routinely moved in and out of collection vehicles. These collection vehicles are equipped with special apparatus for holding the vault in place within the vehicle, including a track arrangement for moving the vaults into and out of the vehicle. The base 17 of the present security vault 16 thus may be configured for use with the existing track arrangement in such collection vehicles; this arrangement is known to those skilled in the art, and need not be discussed further herein.

Figure 3:
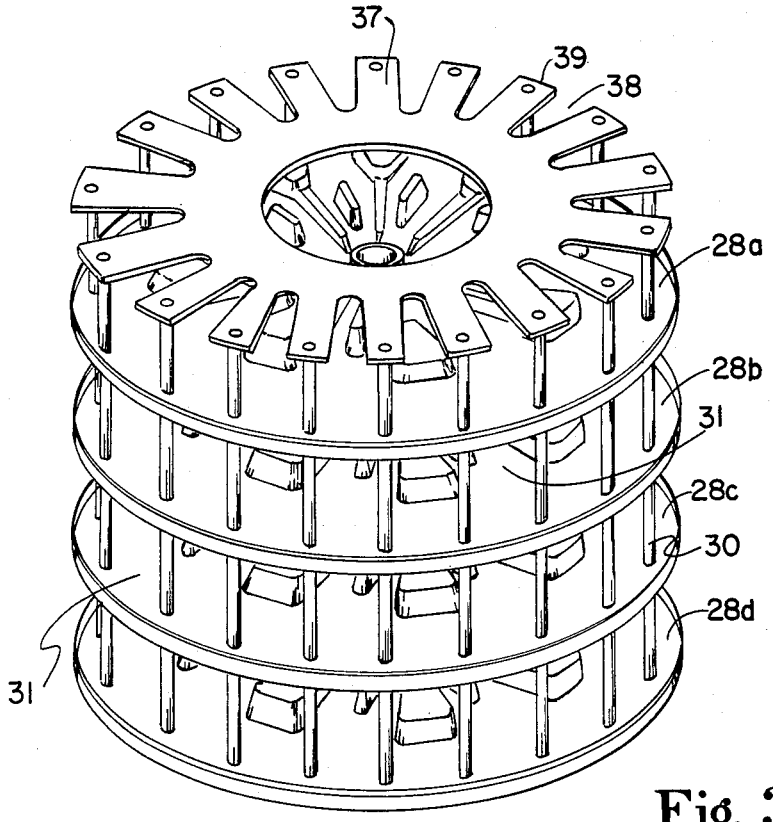
FIG. 3 is a pictorial view of the carousel assembly in the disclosed embodiment.

The security vault 16 includes a carousel assembly 18, FIGS. 2 and 3, surrounding the sleeve 19a supported for rotation around a fixed shaft 19 extending upwardly from the base 17. The carousel assembly 18 rotates with the sleeve 18*a;* a suitable load bearing (not shown) supports the sleeve and the weight of the carousel assembly.

The carousel assembly 18 is contained entirely within a security barrier 20 which prevents unauthorized access to the carousel assembly and its contents. The security barrier 20 includes a cylindrical housing 21 slightly larger in diameter than the carousel assembly, and at least long enough to enclose the entire length of the carousel assembly. The cylindrical housing 21 may preferably be fabricated from expanded metal or the like, permitting visual inspection of the carousel assembly and its contents within while thwarting unauthorized physical access. Alternatively, the cylindrical housing may be fabricated from solid sheet material such as steel or the like.

The upper end of the cylindrical housing 21 is securely joined to the top wall 22 of the security barrier 20. This top wall 22 is a circular sheet of solid material such as sheet steel or the like, entirely enclosing the upper end of the cylindrical housing 21. The upper end of the shaft 19 protrudes through the upper end of the top wall 22 in the disclosed embodiment, as seen in FIG. 1, and a central opening 22*a* (FIG. 2) is provided in the top wall for that purpose. Also seen on the upper wall is the key lock 23 associated with the unlocking cam 126 on the underside 43 of the top wall, for a purpose described below. The cylindrical housing 21 and the top wall 22 are fabricated to form the unitary security barrier 20, which is removable from the security vault 16 by lifting upwardly as illustrated in FIG. 2. The security barrier 20 does not rotate, and the security barrier may be attached to the base 17 by any suitable connecting device. A locking pin 24, FIG. 1, extends through the cylindrical housing 21 near its lower end, for a purpose described below.

The carousel assembly 18, best shown in FIGS. 2 and 3, comprises four separate carousel tiers 28*a*–28*d* coaxially spaced apart from each other. Each of these tiers has a central hub 29 defining an opening through which the sleeve 19*a* extends, as best seen in FIG. 2. The sleeve 19*a* is mechanically attached or otherwise nonrotatably fitted to the central hubs 29 of the tiers. The separate tiers 28*a*–28*d* are rigidly interconnected by a series of spacing rods 30 located a short distance inwardly from the circumference of each tier, and extending parallel to the longitudinal axis of the aligned hubs 29. The angular arc between adjacent spacing rods 30 preferably is uniform around the circular extent of the tiers, and the sectors defined by these arcs comprise the individual receptacles 31 on each tier for receiving coin boxes or other articles within the security vault 16.

Each receptacle 31 on a tier 28*a*–28*d* is further defined by the raised side protrusions 32 (FIG. 2) radially aligned with each spacing rod 30, and by the end protrusion 31 located between adjacent side protrusions and disposed radially inwardly therefrom. The side protrusions and end protrusions preferably may be molded as an integral part of each tier 28*a*–28*d*, and the spacing and location of these protrusions further define the receptacles 31. It will thus be seen that each individual tier 28*a*–28*d* comprises a set of receptacles for receiving coin boxes or the like, with each set comprising a plurality of the individual receptacles 31. Although the particular disclosed embodiment has four tiers 28*a*–28*d*, this is a matter of choice and is not a critical limitation of the present invention.

Mounted above the top tier 28*a* of the carousel assembly 18 is the star plate 37, supported above the upper tier on the ends of the spacing rods 30. The star plate 37 forms part of the rotary indexing mechanism for the carousel assembly 18, and for that purpose a number of indexing notches 38 are formed in the periphery of the star plate. The indexing notches 38 are uniformly spaced around the periphery of the star plate 37 in angular alignment with the receptacles 31 of each tier 28*a*–28*d*, and each indexing notch comprises a generally U-shaped cutout extending inwardly from the peripheral edge 39 of the star plate. The indexing notches 38 may be stamped or otherwise formed in the star plate 37, which may be fabricated from sheet metal or the like.

The carousel assembly 18 is indexed around the shaft 19 by the indexing drive assembly 42, FIG. 6, which is mounted on the underside 43 of the security barrier top wall 22. The indexing drive assembly 42 includes a mounting plate 44 with a driving sprocket 45 rotatably mounted in a one-way bearing 47*a* at one end, and with a driven sprocket 46 rotatably mounted of the mounting plate at the other end. The mounting plate 44 supports the driving sprocket 45 just below the top wall 22 of the security barrier 20, as best seen in FIG. 1, and a handwheel 47 connects to the driving sprocket. A drive chain 48 extends between the driving and driven sprockets of the indexing drive assembly, and also passes over the idler sprocket 49 carried at one end of the L-shaped idler bracket 50, pivotably attached at 51 to the mounting plate 44. A tension spring 52 urges the idler bracket 50 and idler sprocket 49 outwardly away from the mounting plate 44, thereby taking up any slack in the drive chain 48.

The driven sprocket 46 is connected to drive the roller plate 56 carried on the mounting plate 44 at the opposite end from the handwheel 47. A pair of rollers 57 are rotatably mounted on one side of the roller plate 56, which in assembly is located just above the star plate 37 of the carousel assembly 18. The diameter of each roller 57 is slightly less than the width of the open U-shaped indexing notches 38 formed in the star plate 37, and the diametral spacing between the two rollers 57 is substantially equal to the pitch or spacing between the open ends of adjacent indexing notches. The roller plate 56 and the rollers 57 thus function as a Geneva wheel drive for the star plate 37, the rollers engaging the indexing notches 38 on the star plate and indexing the carousel assembly 18 as the roller plate 56 turns in response to manual rotation of the handwheel 47. The one-way drive mechanism 47*a* is of conventional design, permitting the driving sprocket 45 to turn in only a single direction and thus allowing the carousel assembly 18 to be indexed only in one direction. Because at least one roller 57 always engages an indexing notch 38 in the star plate 37 of the carousel assembly, the carousel assembly cannot be manually rotated except by means of the indexing drive assembly 42. The importance of this feature will become apparent in the following discussion of operation.

With the security barrier 20 in place as shown in FIG. 1, the receptacles 31 of the carousel assembly 18 are accessible only through the doorway 60 formed in the cylindrical housing 21 of the security barrier. The width of the doorway 60 is substantially equal to the width of an individual receptacle 31, as best seen in FIG. 5. The doorway 60 longitudinally extends across all tiers 28*a*–28*d* of the carousel assembly 18, so that a selected receptacle 31 on each tier is potentially accessible through the doorway at each indeed position of the carousel assembly.

Figure 4B:
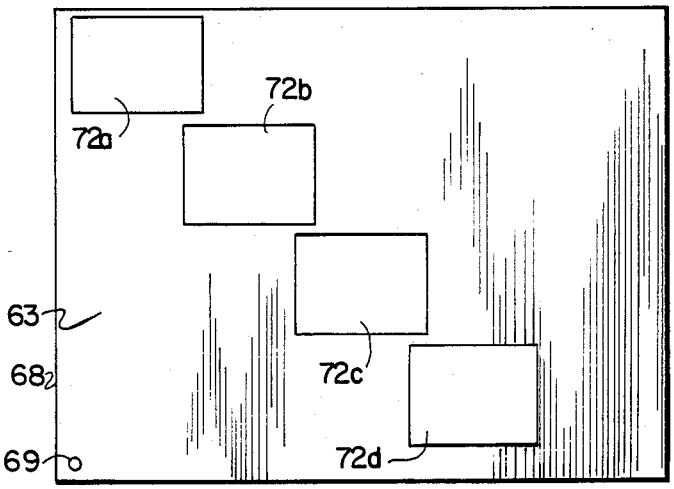
FIG. 4B is an elevation view of the closure in FIG. 4A, shown flattened to avoid perspective distortion.
Figure 4A:
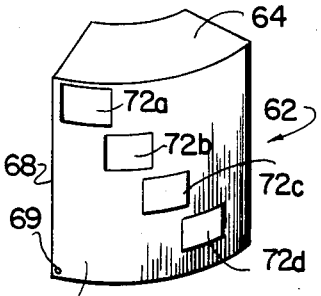
FIG. 4A is a pictorial view of the door in the disclosed embodiment, showing the openings in the arcuate closure.

Access to the carousel assembly 18 through the open doorway 60 is limited by the door 62 concentrically interposed between the cylindrical housing 21 and the peripheral edge 39 of the carousel assembly, as best seen in FIG. 2. The door 62, best seen in FIGS. 4A and 4B, includes a door panel 63 in the shape of a cylindrical section radially interposed between the cylindrical housing 21 and the carousel assembly 18. The upper and lower ends of the door panel 63 are attached to the upper and lower sector plates 64 and 65, respectively. The upper sector plate 64 extends inwardly from the door panel 63, and is fastened to an attachment plate 66 extending outwardly from the hub 67 of the detent wheel 76. The detent wheel 76 is freely rotatable about the sleeve 19*a*, above the star plate 37. The lower sector plate 65 supporting the door panel 63 is similarly mounted to a hub (not shown) rotatably disposed on the sleeve 19*a*, below the lowermost tier 28*d* of the carousel assembly.

Turning again to FIGS. 4A and 4B, a series of four separate access openings 72*a*–72*d* are formed in the door panel 63. The elevation (in the vertical dimension on FIG. 4B) of each access opening on the door panel coincides with the vertical location of the corresponding tiers 28*a*–28*d* on the carousel assembly 18. However, the access openings 72*a*–72*d* are staggered across the horizontal dimension of the door panel 63, so that only one such access opening at a time can be aligned with the doorway 60 in the cylindrical housing 21, for any particular angular position of the door 62 about the sleeve 19*a* of the security vault.

Two different examples of this angular relationship are seen in FIGS. 1 and 5. In FIG. 1, the access opening 72*a* is aligned with the doorway 60, allowing access only to the receptacles 31 in the uppermost tier 28*a* of the carousel assembly. In FIG. 5, the door 62 has been angularly displaced in a clockwise direction, placing the access opening 72*b* in alignment with the doorway 60 for access to the receptacles in the second tier 28*b*. In the position of FIG. 5, the access opening 72*a* has been displaced to the left of the doorway 60, and the next access opening 72*c* is substantially to the right of the doorway. Each access opening 72*a*–72*d* is configured to permit substantially unimpeded access to the receptacles 31 of the corresponding tiers 28*a*–28*d* of the carousel assembly, as the door 62 is properly aligned with the doorway 60.

The door 62 also can be moved backward or counterclockwise to place the leading edge 68 of the door panel 63 immediately at the right of the doorway 60, thus simultaneously exposing all tiers 28*a*–28*d*. The locking pin 24 can be moved inwardly to engage the locking hole 69 in the lower left corner of the door 62.

Figure 8:
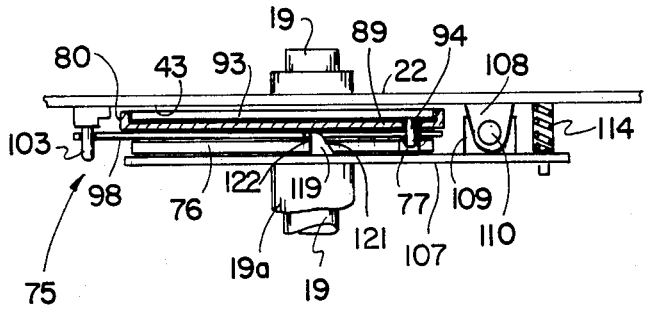
FIG. 8 is a detailed elevation view of the door drive assembly in the disclosed embodiment.
Figure 9:
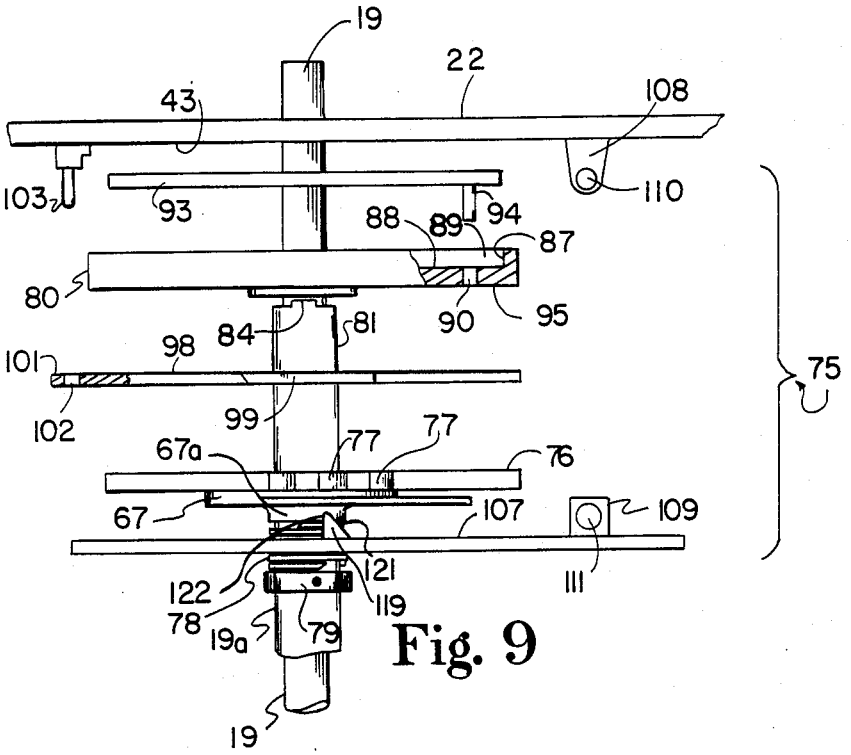
FIG. 9 is an exploded view of the assembly shown in FIG. 8.

The angular positioning of the door 62 relative to the doorway 60 is controlled by the driving and locking mechanism indicated generally at 75 in FIG. 2, and best detailed in FIGS. 8 and 9. This indexing and locking mechanism 75 includes a detent wheel 76 affixed to the upper side of the hub 67, FIG. 2, and having several detent notches 77 extending radially inwardly from the circumference of the detent wheel. The number of detent notches 77 on the detent wheel preferably exceeds by one the number of access openings 72*a*–72*d* in the door panel 63, and the angular location of these detent notches determines the locations at which the door 62 indexes and locks. With the door 62 movable with the hub 67, and the hub being freely rotatable relative to the sleeve 19*a*, the detent plate 76 and the door likewise are freely rotatable on the sleeve.

Figure 15B:
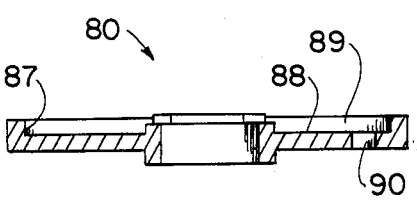
FIG. 15B is a section view along line 15B—15B of FIG. 15A.
Figure 15A:
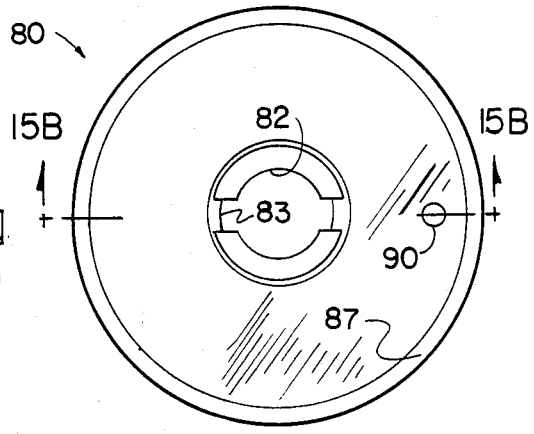
FIG. 15A is a top plan view of the index drive wheel in the door drive assembly.

Another component of the indexing and locking mechanism 75 is the index drive wheel 80, FIGS. 15A and 15B, which is keyed to the upper end 81 of the sleeve 19*a* surrounding the shaft 19. The sleeve 19*a* thus drives the index drive wheel 80, and the index wheel rotates with the sleeve 19*a* and the carousel assembly 18 as the carousel assembly is indexed by the indexing drive assembly 42. The index drive wheel 80 has an inner hub 82 in which are formed a pair of notches 83 to receive the lugs 84 at the upper end 81 of the sleeve 19*a*.

The index drive wheel 80 has a peripheral flange 87, FIGS. 9 and 15A, extending upwardly from the top surface 88 of the drive wheel. This peripheral flange 87 thus defines a shallow annular well 89 on the top side of the index drive wheel 80, surrounding the inner hub 82. An opening 90 radially spaced apart from the inner hub 82 extends through the index drive wheel 80, inside the annular flange 87.

A drive pin plate 93, also forming part of the indexing and locking mechanism 75, loosely fits within the well 89 on the upper side of the index drive wheel 80. The drive pin plate 93, best seen in FIGS. 2 and 9, is shaped like an enlarged washer having a center opening large enough to fit over the inner hub 82 of the index drive wheel. The outer diameter of the drive pin plate 93 is sufficiently less than the diameter of the well 89, defined by the flange 87, so that the drive pin plate loosely fits in the well and can assume a cocked angular position relative to the index drive wheel 80, as exemplified in FIG. 13A.

A drive pin 94 is affixed to the underside of the drive pin plate 93. The drive pin 94 is radially located for alignment with the opening 90 in the index drive wheel 80. The diameter of the drive pin 94 is slightly less than the diameter of the opening 90, allowing the drive pin free longitudinal movement within the opening. The drive pin 90 is long enough to protrude below the bottom surface 95 of the index drive wheel 80, when the drive pin plate 93 is fully nested within the well 89 as shown in FIGS. 13B and 13C.

A cover plate 98, FIGS. 9, 10 and 11, is axially interposed between the detent wheel 76 and the index drive wheel 80 of the indexing and locking mechanism 75. This cover plate 98 rests on top of the detent wheel 76, and has a peripheral cutout portion 99 coextensive in angular extent with two adjacent detent notches 77 in the detent wheel 76. A central opening 100 in the cover plate 98 permits free rotation about the sleeve 19*a*.

The outer diameter of the cover plate 98 may be substantially the same as that of the detent wheel 76 and the index drive wheel 80, between which the drive pin plate is sandwiched. However, the cover plate 98 includes a tab 101, FIGS. 9 and 10, radially extending beyond the detent wheel and the index drive wheel. A hole 102 is formed in the tab 101, for alignment with the locating pin 103, FIGS. 2 and 9, projecting downwardly from the underside 43 of the top wall 22 making up the security barrier 20. The locating pin 103 enters the hole 102 in the cover plate 98 as the security barrier 20 is positoned to enclose the indexing and locking mechanism 75, thereby positioning the cutout 99 of the cover plate in proper position with respect to the detent notches 77 of the detent wheel 76 in a manner described below.

The indexing and locking mechanism 75, in assembly as shown in FIG. 8, fits between the security barrier top wall 22 and the detent lever 107, which comprises another element of the indexing and locking mechanism. The detent lever 107 is pivotably attached to the top wall 22 by a bracket 108 extending downwardly from the underside 43 of the top wall. A mounting lug 109 is located near one end of the detent lever 107 and fits within the bracket 108; a pivot pin 110 fits through aligned holes in the bracket 108 and the hole 111 in the mounting lug 109, supporting the detent lever 107 for a limited extent of pivoting movement in a plane perpendicular to the top wall 22 of the security barrier. A compression spring 114 fits between the underside 43 and the short end 115 of the detent lever 107, urging the longer end 116 of the detent lever upwardly toward the underside of the top wall 22.

A detent lug 119 is located on the upper side 120 of the detent lever 107, part way between the mounting lug 109 and the longer end 116 of the detent lever. The leading edge 121 of the detent lug, facing the mounting lug 109, is beveled to provide a ramp surface best seen in FIGS. 7 and 8. The opposite or trailing edge 122 of the detent lug, facing the longer end 116 of the detent lever, is substantially perpendicular with the upper side 120 of the detent lever. The overall shape of the detent lug 119 allows that lug to enter each detent notch 77 on the detent wheel 76. The compression spring 114, acting on the detent lever 107 on the other side of the pivot pin 110, urges the detent lug 119 upwardly against the underside of the detent wheel 76.

Figure 14:
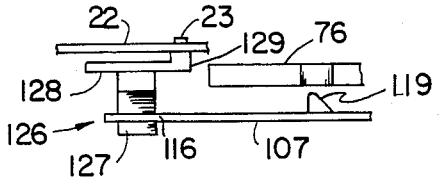
FIG. 14 is a fragmentary elevation view showing details of the unlocking cam in the disclosed embodiment.

The detent lug 119 can be withdrawn from the detent wheel 76 by the unlocking cam 126, FIGS. 2 and 14, mounted on the underside of the top wall 22 for the security barrier 20. This unlocking cam 126 is disposed at the free end of a crank lever 128, and the unlocking cam has a downwardly facing cam surface 127 located adjacent the longer end 116 of the detent lever 107. The other end 129 of the crank lever 128 is connected to a rotatable portion of the key lock 23 extending downwardly through the top wall 22.

The crank lever 128 is rotatable between two positions, the first of which is seen in FIG. 2. In that position, the cam surface 128 is withdrawn from the detent lever 107, allowing the spring 114 to move the detent lever and the detent lug 119 upwardly into engagement with the underside of the detent wheel 76. When the crank lever 128 is rotated approximately 180° to its other position seen in FIG. 14, the cam surface 127 engages the longer end 116 of the detent lever 107 and moves that end of the detent lever downwardly against the force of the spring 114, withdrawing the detent lug 119 from engagement with the detent wheel 76. The crank lever 128 is operable only when the key is inserted and rotated in the key lock 23.

The operation of the security vault 16 will now be discussed. For this discussion, it is assumed that the door 62 initially is in its full-counterclockwise position shown in FIG. 1, placing the access opening 72*a* in alignment with the doorway 60 and allowing access only to the uppermost tier 28*a* in the carousel assembly 18. With a typical application of the security vault, an empty coin box or the like (not shown) is already inserted in each receptacle 31 of the carousel assembly, although this assumption is not required for operation of the security vault. These empty coin boxes normally are loaded into the security vault at a central location, and the security vault then is transferred to a collection vehicle for making the rounds of pay telephones or the like.

The first coin box removed from a pay telephone is swapped with the empty coin box located at the first receptacle 31 exposed to view through the uppermost access opening 72*a* in the door 62. The collecting attendant then manually rotates the handwheel 47 to index the carousel assembly 18 far enough to move the next receptacle 31 of the tier 28a into alignment with the access opening 72*a* and the doorway 60. The receptacle 31 previously accessible through the access opening 72*a*, along with the removed coin box inserted therein, now is moved beyond the doorway 60 of the security barrier, and is no longer accessible to the operator or to others. At the same time, the empty coin box in the next receptacle now can be replaced by another coin box removed from another pay telephone or the like. This indexing operation of the carousel assembly 18 can be repeated until all receptacles 31 of the uppermost tier 28*a* have been indexed seriatim past the doorway 60 and the aligned access opening 72*a*, the door 62 remaining fixed during this time.

Figure 13A:
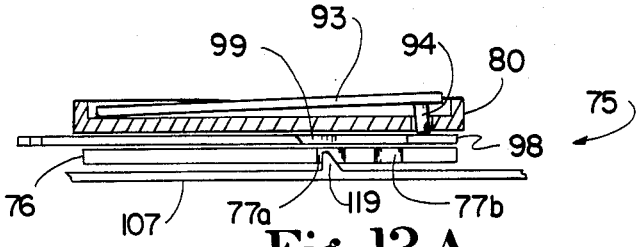
FIGS. 13A–13D are elevation views of the door drive assembly, corresponding to FIGS. 12A–12D.
Figure 13B:
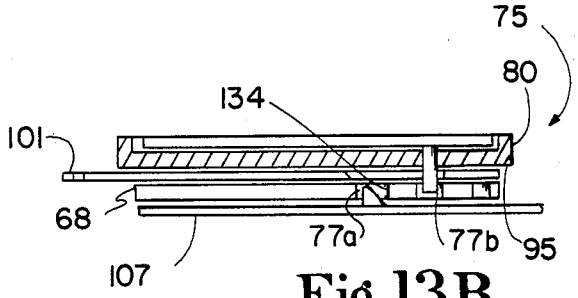
Figure 13C:
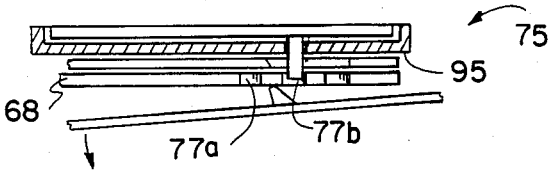

While the carousel assembly 18 was indexed by the handwheel 47 as described above, the door indexing and locking mechanism remained in the state depicted in FIGS. 12A and 13A. The detent lug 119 during this time engaged the first detent notch 77*a* of the detent wheel 76, holding the detent wheel and the attached door 62 from any attempt to displace the door counterclockwise by manual efforts or otherwise. The drive pin plate 93 is tilted upwardly within the well 89 of the index drive wheel because the drive pin 94 at this time is riding along the top of the cover plate 98, as illustrated in FIGS. 12A and 13A. Accordingly, the index drive wheel 80 remains decoupled from the detent wheel 76 as the carousel assembly 18, the sleeve 19*a*, and the index drive wheel are indexed in rotation by the hand wheel 47.

The drive pin 94 of the drive pin plate 93 slides along the top of the cover plate 98 as the carousel assembly is indexed in its first complete revolution. When the first revolution is completed, aligning the last receptacle 31 of the uppermost tier 28*a* with the doorway 60, the drive pin 94 arrives at the leading edge 132 of the cutout 99 in the cover plate 98. The drive pin 94 thus drops through the cutout 99 and comes to rest in the detent notch 77*b* of the detent wheel 76, a condition shown in FIGS. 12B and 13B. At this time, the drive pin plate now is fully received in the well 89 on the upper side of the index drive wheel 80. The indexing and locking mechanism 75 now is ready to index the door 62 to expose the next tier 28*b* of the carousel assembly, all receptacles of the tier 28*a* having been indexed past the doorway 60 and presumably filled with coin boxes containing money.

When the hand wheel 47 is next rotated to index the carousel assembly, the index drive wheel 80 rotates with the sleeve 19*a* and the carousel assembly as before. This time, however, the drive pin 94 engages the detent notch 77*b* in the detent wheel 76, temporarily coupling the detent wheel for rotation with the index drive wheel. The back wall 134 of the first detent notch 77*a* contacts the ramp surface 121 on the leading edge of the detent lug 119 carried by the detent lever 107, and cams down the detent lug and detent lever out of engagement with the detent notch 77a. The detent wheel 76, which previously became temporarily coupled to the index drive wheel 80, now is temporarily unlocked for rotation. This condition is best seen in FIGS. 12C and 13C.

The detent wheel 76 and the door 62 now rotate in unison with the carousel assembly 18 and the index drive plate 80, as the carousel assembly is indexed to align the next receptacle 31 with the doorway 60. The door panel 63 thus moves clockwise with the carousel assembly, shifting the uppermost access opening 72*a* out of alignment with the doorway 60 and bringing the next access opening 72*b* into alignment with the doorway. This condition is illustrated in FIG. 5.

Figure 13D:
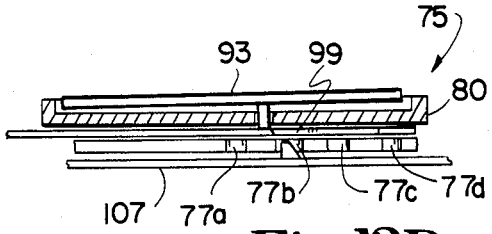

When the next access opening 72*b* is fully aligned with the doorway 60, the detent notch 77*b* is moved to the position shown in FIGS. 12D and 13D, placing that notch in alignment with the detent lug 119 of the detent lever 107. The detent lug 119 now moves upwardly under urging of the spring 114, and this upward movement displaces the drive pin 94 up and out of the detent notch 77*b*. The beveled trailing edge 133 of the cutout 99 in the cover plate 98 (best seen in FIGS. 10 and 11) helps move the drive pin 94 back up onto the top surface of the cover plate, in response to a further increment of rotation of the index drive wheel 80. The index drive wheel 80 thus is again decoupled from the detent wheel 76, and the drive pin plate 93 reassumes the tilted position shown in FIG. 13A. Furthermore, the detent lug 119 has reengaged the detent wheel, this time in the detent notch 77*b* instead of 77*a* as previously, locking the detent wheel 76 (and thus the door 62) from reverse rotational movement. The blunt trailing edge 122 of the detent lug 119 provides no camming action, and blocks any attempt to return the door 62 to its initial position. Thus, the uppermost access opening 72*a* in the door 62 cannot be returned to alignment with the doorway 60, and so all the coin boxes previously loaded in the uppermost tier 28*a* of the carousel assembly 18 now are inaccessible to theft or pilferage.

The wrap spring clutch 78 (FIG. 2) frictionally fits on the hub extension 67*a* extending downwardly from the underside of the detent wheel hub 76, and frictionally wraps around a longitudinal portion of the sleeve 19*a* immediately below the hub extension. The collar 79 fastened to the sleeve 19*a* supports the lower end of the wrap spring. This wrap spring clutch 78 is pitched to wrap more tightly on the hub extension 67*a* and the sleeve 19*a* when the door 62 attempts forward movement relative to the carousel and sleeve 19*a*, thereby engaging the hub extension with the sleeve. The door 62 thus cannot move forward unless the carousel assembly also moves forward, preventing anyone from tampering with the door by manually reaching through the doorway 60.

With the access opening 72*b* now aligned with the doorway 60, further operation of the hand wheel 47 again indexes the carousel assembly 18 as before, seriatim moving each receptacle 31 of the second tier 28*b* past the access opening 72*d*. The empty coin boxes previously placed in these receptacles are now replaced seriatim by coin boxes removed from pay telephones or the like, until the carousel assembly completes its full second revolution. At that time, the drive pin 94 of the door indexing and locking mechanism 75 again arrives at the cutout 99 in the cover plate 98, initiating another cycle of the indexing and locking mechanism. The door 62 thus again is indexed, moving the access opening 72*b* past the doorway 60 and behind the security barrier 20 and moving the next access opening 72*c* into alignment with the doorway 60.

This sequence of operating steps continues until the carousel assembly 18 is indexed a full revolution after the last access opening 72*d* is aligned with the doorway 60. At that time, the extra detent notch 77*e* (FIG. 2) on the detent wheel 76 is engaged by the drive pin 94, moving the door 62 to place the last access opening 72*d* beyond the doorway 60. At this time, all tiers 28*a*–28*d* of the carousel assembly 18 are blocked from access through the door 60 of the security barrier 20, and the security vault 16 can be returned to a suitable central location for further handling.

The coin boxes are removed from the security vault 16 by unlocking the indexing and locking mechanism 75. This is accomplished by inserting the proper key in the key lock 23 and rotating the crank lever 128 to move the unlocking cam 126, urging the cam surface 127 against the longer end 116 of the detent lever 107 and withdrawing the detent lug 119 from the detent wheel 76. With the detent lug 119 thus withdrawn as illustrated in FIG. 14, the door 62 can be manually manipulated through the doorway 60 and moved back t place the leading edge 68 to the right of the doorway 60, thus exposing all tiers 28*a*–28*d* to access through the doorway. The wrap spring clutch 78 wraps more loosely by this backward movement of the door 62 and disengages the hub extension from the sleeve 19a, so that the clutch does not prevent backward movement of the door relative to the carousel assembly. The carousel assembly 18 now is indexed by the hand wheel 47, moving the receptacles 31 past the doorway 60 and permitting removal of the filled coin boxes from each receptacle in the carousel assembly, while the locking pin 24 holds the door 62 stationary. A fresh supply of empty coin boxes can also be loaded into the carousel assembly at this time, if desired. When the removal of filled coin boxes is completed, door 62 is returned to the initial position shown in FIG. 1 and the key lock 23 is manipulated to withdraw the locking cam 126 from the detent lever 107, whereupon the security vault 16 once again is initialized for use.

It will be understood that the foregoing relates only to a preferred embodiment of the present invention, and that numerous modifications and changes may be made therein without departing from the spirit and scope of the present invention as defined in the following claims.

We claim:

1. Security vault apparatus for receiving and permitting seriatim access to a number of articles, comprising:

support means defining plural sets of receptacles for receiving articles, each said set comprising a plurality of said receptacles;

barrier means associated with said support means and including opening means selectively operative to block access to all but a selected one such set of receptacles at a time, thereby permitting access only to said one set of receptacles at a time;

means operative to move said support means relative to said barrier means and expose seriatim each separate receptacle of a selected set of receptacles to access through said opening means; and means operative to reposition said barrier means relative to said support means only when all the receptacles of said one set have been exposed to access, blocking further access to said one set of receptacles and permitting access only to another said set of receptacles for seriatim exposure through said opening means, whereby articles can be inserted or removed at only one receptacle at a time.

2. Security vault apparatus for receiving and permitting seriatim access to a number of articles, comprising:

support means defining plural sets of receptacles for receiving articles, each said set comprising a plurality of said receptacles;

said support means having plural tiers of receptacles and each set of receptacles being on a separate tier;

barrier means associated with said support means and including opening means selectably operative to permit access only to one such set of receptacles at a time;

said opening means comprising a separate opening for each tier of receptacles, said separate openings located so that only one tier at a time can be exposed to access by means of an opening in said barrier means;

means operative to move said support means relative to said barrier means and expose seriatim each separate receptacle of a selected set of receptacles to access through said opening means; and means operative to reposition said barrier means relative to said support means when all the receptacles of said one set have been exposed to access so as to prevent further access to said one set of receptacles and permit access only to another said set of receptacles for seriatim exposure through said opening means, whereby articles can be inserted or removed at only one receptacle at a time.

3. Apparatus as in claim 2, further comprising:

means operative to move said support means relative to said barrier means so that each receptacle of a set is indexed seriatim relative to the opening for that set; and means operative in response to movement of a certain receptacle of a set to reposition said barrier means so as to block access to the preceding tier and permit access to the receptacles of another tier for seriatim movement relative to another said opening of said barrier means.

4. Security vault apparatus for permitting seriatim access to a number of regions, comprising:

a rotatable carousel having a plurality of tiers;

each tier being divided into a plurality of regions for receiving articles;

a security barrier enclosing said carousel and blocking access to said regions;

said barrier having a doorway permitting access only to a limited number of said regions on a selected tier, at each rotational position of said carousel;

means operative to rotate said carousel so that each region of the tiers is aligned seriatim for access by means of said doorway;

door means preventing access to said carousel through the doorway and having access opening means, said door means being movably alignable with respect to said doorway so as to allow access through the doorway only to a selected tier;

holding means selectably engaging said door means in position with respect to said doorway to place the opening means in alignment with a selected tier, so that only the regions of that selected tier are accessible seriatim by means of said doorway as the carousel is rotated;

release means operative in response to a predetermined rotational position of the carousel to release said holding means from said door means, and operative to connect the door means for movement in response to further rotation of the carousel, so that the opening means moves out of alignment with said selected tier and moves toward alignment with a new selected tier of the carousel; and said holding means operative to reengage said door means when the door means is moved to align with said new selected tier, so that only the regions of the new selected tier are accessible seriatim in response to further rotation of the carousel.

5. Apparatus as in claim 4, wherein:

said regions are accessible at the periphery of the carousel;

said security barrier prevents access to the periphery of the carousel and said regions, except through said doorway;

said door means is mounted for selective movement concentric with said carousel;

the access opening means of said door means includes an opening portion corresponding to each tier of the carousel; and said opening portions and said doorway of the security barrier are angularly offset relative to each other at the periphery of the carousel, whereby access to a particular tier of the carousel is selected by angularly positioning the door means to align the doorway with the mutually offset opening portion corresponding to the particular tier.

6. Apparatus as in claim 4, wherein:

said regions are accessible at the periphery of the carousel;

said security barrier permits peripheral access to the regions only at said doorway;

said door means is located in closely spaced concentric relation to said security barrier periphery;

means supporting said door means for concentric movement relative to the carousel, so that the angular position of said access opening means with respect to said doorway is selectably variable; and said security barrier doorway and said access opening means are angularly offset, one relative to the other, along a peripheral portion of the carousel so that access to the periphery of the regions of a particular tier is possible only at a certain angular position of the door means.

7. Security vault apparatus for seriatim access to a plurality of receptacles, comprising:

a rotatable carousel having a plurality of tiers mutually spaced apart along the rotational axis of the carousel;

means dividing each tier into a plurality of sectors for receiving receptacles or the like;

a security barrier associated with said carousel and having a portal, said security barrier preventing access to said sectors except through a portal formed in the security barrier;

indexing means operative to rotate said carousel in a forward direction in predetermined increments correlated to said sectors so that each sector is aligned seriatim with said portal in the security barrier;

door means concentric with said carousel and selectably preventing access to the sectors aligned with the portal in the security barrier;

means associated with said door means and defining an access opening for each tier of said carousel, each said access opening permitting access through said portal to the sectors of a corresponding tier on the carousel; and said portal and said access openings being offset relative to each other along the axial and angular extents of the carousel, so that access to a particular tier of the carousel is selected by angularly positioning the door means for mutual alignment of the portal and the access opening for that tier, whereby each sector of that particular tier moves seriatim past the mutually aligned portal and access opening as the carousel is rotated by said indexing means.

8. Apparatus as in claim 7, further comprising:

means mounting said door means for rotation concentric with said carousel and independently thereof;

detent means rotatable with said door means and having detents corresponding to the angular positions of the door which position the access openings for access to each tier of the carousel;

detent holding means mounted in fixed relation to said detent means and selectably operative to engage and hold a detent in position when the door means and detent means are angularly positioned to align an access opening with said portal;

said detent holding means keeping the detent means from moving in the direction opposite said forward direction, so that the door means cannot be moved backward to regain access to a tier previously selected for access;

detent driving means rotating with said carousel and operative to drivingly engage said detent means when the carousel is rotated by said indexing means to a predetermined position, so that the detent means and the door means can move with further rotation of the carousel to align the access opening with the next tier; and said detent holding means operating to disengage the detent driving means and re-engage the detent means in response to alignment of the access opening with the next tier, whereby the door means portal is held in alignment with said next tier as the sectors of that tier are moved seriatim past the portal by still further rotation of the carousel.

9. Apparatus as in claim 8, wherein:

said detent means comprises a radial member mounted for rotation concentric with said carousel and independently thereof;

said radial member having detents angularly separated in correlation with the angular offset of the access openings associated with the door means;

said detent driving means is biased toward engagement with said radial member at a first angular position so as to engage a detent and drive the radial member when the detent driving means arrives at that first position; and said detent holding means is biased toward engagement with said radial member at a second angular position following said first position, and operatively disengages the detent driving means from the previously-engaged detent as the radial member reaches said second angular position.

10. Apparatus as in claim 9, wherein:

said detents comprise openings defined on said radial member;

said detent driving means comprises a first member at one side of the radial member and biased to engage an opening at said first position; so as to interconnect the radial member with the carousel and thereby move the radial member in response to rotation of the carousel beyond the first position; and said detent holding means comprises a second member at the other side of the radial member and biased to engage said opening at said second position and displace said first member from said opening, so as to prevent movement of the radial member in said opposite direction.

11. Apparatus as in claim 8, wherein:

said detent means comprises a detent wheel connected to said door means and mounted for rotation concentric with said carousel;

said detents comprising apertures formed on said detent wheel;

said detent driving means comprises a drive pin at one side of said detent wheel and biased toward the detent wheel at a first angular position of the detent wheel so as to enter an aperture arriving at said first position; and said detent holding means comprises a pawl biased toward the other side of said detent wheel at a second angular position beyond said first position, said panel operative to disengage said drive pin from the aperture at said second position and there hold said detent wheel against rotation in said opposite direction.

12. Apparatus as in claim 11, wherein said detent driving means further comprises:

a drive wheel rotating with said carousel;

said drive pin being rotatably carried by said drive wheel and axially urged toward said one side of the detent wheel; and a cover member located between said drive wheel and said detent wheel and permitting said drive pin to engage an aperture in said detent wheel only when the drive wheel arrives at said first angular position.

13. Apparatus as in claim 12, wherein:

said cover member defines a slot through which said drive pin is axially urged toward said one side of the drive wheel;

said slot having a leading edge permitting the drive pin to engage said aperture at the first angular position, and having a trailing edge aligned with said second angular position; and said trailing edge defining a ramp surface along which the drive pin moves from disengagement from the detent wheel by said pawl.

14. Apparatus as in claim 11, further comprising:

release means selectively operative to withdraw said pawl from engagement with said detent wheel, so that the detent wheel and the door means selectably move in said opposite direction independent of said carousel.

* * * * *